United States Patent [19]

Godbout et al.

[11] Patent Number: 4,750,546

[45] Date of Patent: Jun. 14, 1988

[54] AUTOMATIC BASEBOARD DAMPER SYSTEM

[75] Inventors: Arthur R. Godbout, West Hartford; Russell F. Lord, Glastonbury; Raymond Pulver, Newington; Michael W. Pastore, West Simsbury, all of Conn.

[73] Assignee: Argo Industries, Inc., Berlin, Conn.

[21] Appl. No.: 353,474

[22] Filed: Mar. 1, 1982

[51] Int. Cl.[4] ..... F24D 19/02

[52] U.S. Cl. ..... 165/55; 236/38; 236/91 R; 237/70

[58] Field of Search ..... 237/70, 79; 165/40, 165/55; 236/38, 9 R, 91 R

[56] References Cited

U.S. PATENT DOCUMENTS

| | | | |
|---|---|---|---|
| 1,686,040 | 10/1928 | Simmon | 236/38 |
| 1,826,100 | 10/1931 | Stewart | 236/38 |
| 1,990,895 | 2/1935 | Callahan | 236/38 |
| 3,386,501 | 6/1968 | Pastore | 165/82 |
| 3,517,881 | 6/1970 | Kohlbeck et al. | 236/38 |
| 3,650,320 | 3/1972 | Newton | 236/38 |

FOREIGN PATENT DOCUMENTS

| | | | |
|---|---|---|---|
| 2246823 | 5/1975 | France | 236/38 |

*Primary Examiner*—Ira S. Lazarus
*Assistant Examiner*—Peggy Neils
*Attorney, Agent, or Firm*—Kramer, Brufsky & Cifelli

[57] ABSTRACT

Radiator housing assembly, for a hydronic baseboard heater for heating a room or area, forming a part of an overall building or zone heating system having a master thermostat, said assembly having a damper which is positionable between open and closed positions in a controlled manner to regulate the flow of heated ambient air therethrough. The damper is adapted for automatic electrical positioning in response to a remote control device, such as an adjustable thermostat in the room or area to be heated in order to maintain the room or area at a predetermined desired temperature at or lower than the temperature setting on the master thermostat, thereby conserving energy.

12 Claims, 3 Drawing Sheets

AUTOMATIC BASEBOARD DAMPER SYSTEM

BACKGROUND OF THE INVENTION

The present invention relates to improvements in housings for radiator systems, most particularly for hydronic baseboard systems of the general type disclosed, for example, in U.S. Pat. No. 3,386,501. Such housings enclose a length of water-circulation conduit, such as copper piping, upon which is mounted an assembly of closely-spaced thin aluminum fins, to provide a heat-radiator along the baseboard of a room to be heated. Hot water circulated through the conduit, from a furnace boiler, conducts heat to the fins which transfer heat to the ambient air flowing between the fins. The heated air rises up out of the fins and is displaced by cooler air drawn between the fins from below.

In conventional hydronic baseboard heating systems, the conduit length and fin assembly is contained within a radiator housing which is open at the bottom and contains a manually-adjustable hinged or pivotable damper at the top. In rooms or areas of rooms where less heat is desired or required, the damper of the radiator heating such rooms or areas can be closed manually to block the rise and escape of heated air from the housing, thereby blocking the circulation of cooler ambient air into the housing, reducing the transfer of heat from the conduit and permitting the heating water to return to the furnace boiler at a higher temperature. This conserves the amount of energy required to maintain the boiler at a temperature necessary to heat the other rooms of the house, and also maintains some of the rooms or areas cooler, as desired.

Baseboard systems are available in which the individual radiators contain valve means for preventing the circulation of hot water through the length of conduit thereof to completely bypass one or more radiators in a heating system. Such valved systems are expensive and the valves thereof are subject to malfunction. Also such valved systems are disadvantageous because they prevent any heat from entering the radiator, when the valves are closed, whereby no heat enters the room. In cases of extreme cold, the water within the isolated water conduit or copper piping can freeze and burst the piping on expansion.

While radiator systems having manually-operative dampers are less expensive and more trouble-free than valved radiator systems, they generally are not used to their full potential because many people are unaware of the function of the dampers, or the dampers become stuck and non-movable with age or due to painting, More commonly, the dampers are inaccessible due to the presence of large pieces of furniture in front of the baseboard radiators.

SUMMARY OF THE INVENTION

The present invention relates to an improved radiator heating system in which the radiator housing includes a damper panel which is moveable between open and closed positions, and the invention is characterized by the presence of means for automatically moving the damper panel between open and closed positions in response to an electrical signal, preferably a signal from an adjustable temperature-sensing device such as a thermostat which is located within the room or area of the room in which the temperatue regulation is desired.

The present invention includes such a system in which a plurality of such radiator housings are present within a plurality of rooms of a house, office building or other living space, each of the housings being associated with a common heating conduit or zone of heating conduit which circulates hot water in response to a master thermostat which is centrally located. The invention contemplates the use of secondary thermostats or other switching means in one or more of the rooms or areas of the living space to permit the ambient temperature of such rooms or areas to be automatically and independently regulated at or below the maximum heating temperature provided by the master thermostat, preferably within an adjustable temperature range, without adjusting the setting of the master thermostat.

BRIEF DESCRIPTION OF THE DRAWING

In the accompanying drawing:

FIGS. 1 and 2 illustrate an hydronic baseboard radiator assembly of the structure disclosed in detail in U.S. Pat. No. 3,386,501, the disclosure of which is incorporated herein by reference. The assembly comprises a heat-transfer element comprising a water circulation conduit 10 supporting a plurality of spaced, heat-conductive fins 11, and a support housing 12 which substantially encloses the heat-transfer element. The housing 12 comprises a substantially vertical rear wall panel 13 to which is attached a plurality of hanger bodies, each comprising a support arm 15 and a lower bracket arm 16. The lower bracket arms 16 support the finned conduit 10 and the lower portion of the substantially vertical front panel 17 of the housing. The support arms 15 support the upper portion of the front panel 17 and also include hinge tabs 18 which hingedly support damper panel 19 between open and closed positions. Damper panel 19 is shown in substantally horizontal closed position in FIGS. 1 and 2, in which position it substantially closes the upper opening of the housing 12 to block or restrict the rise and escape of heated air from the finned conduit 10. This blocks the normal circulation of air up through the fins 11 so that the room or area served by the radiator assembly is insulated somewhat from the finned conduit 10 and is maintained somewhat cooler than the maximum temperature which would be provided if the damper was in open position, which maximum temperature is controlled by a master or furnace thermostat. End caps 14 are also provided on the housing 12 to form substantially vertical side walls thereon.

FIG. 3 shows the damper panel 19 pivoted into open position by a spring 20, one such spring being attached between the inner edge of the damper panel 19 and the bottom edge of one or more of the support arms 15 to normally bias the damper panel 19 into open position. In such position the surrounding air in a room or area being serviced by the radiator is able to circulate freely through the housing 12 whereby air heated between the fins 11 rises up out of the top opening, uncovered by the damper panel 19, and cooler air is drawn into the housing 12 through the open bottom thereof. This provides maximum heat transfer from the finned conduit and maximum heating of the room or space serviced by the radiator.

Figure 1:
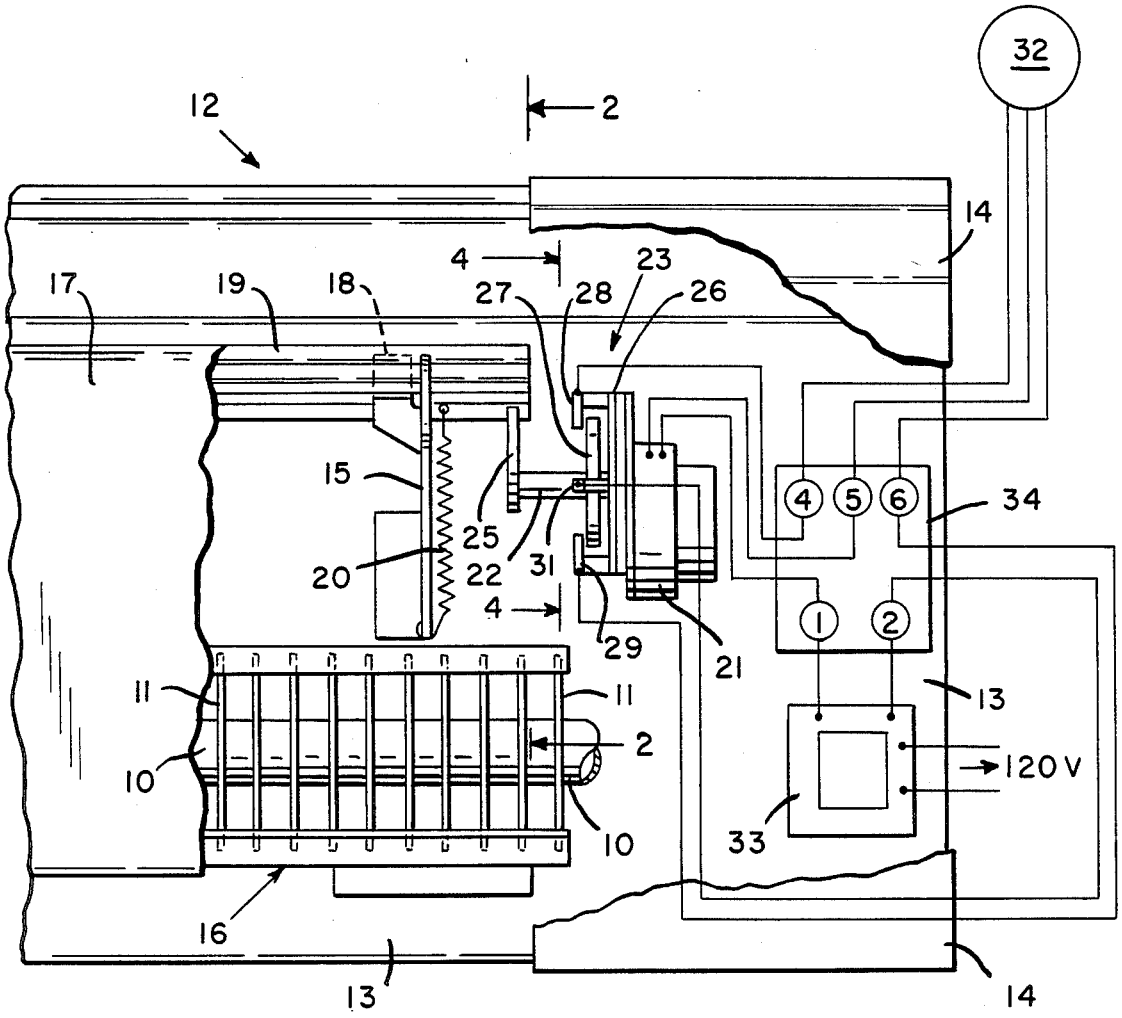
FIG. 1 is a front view of an hydronic baseboard radiator assembly according to one embodiment of the present invention, portions thereof being broken away for purposes of illustration.

The essential feature of the present invention is an electrical damper-actuating means for automatically opening and closing the damper panel 19 of a radiator housing 12, preferably in response to changes in the ambient temperature within a room or area serviced by the radiator. The present drawings illustrate such a means, according to a preferred embodiment, comprising a 24 volt AC electric synchronous or torque motor 21 which is attached to the rear wall panel 13 of the radiator housing and which has a gear-reduction output shaft 22 associated with a rotation programmer 23 and a damper acutator extension which, according to the embodiment of FIGS. 1 to 3, comprises a cam disc or wheel 25 which is fixed to the end of the shaft 22 in an off-set position. The rotation programmer 23 comprises a fixed contact plate 26 which is attached to the motor and has a central opening through which the shaft 22 passes for free rotation therewithin, and a rotatable conductive contact disc 27 which is attached to the output shaft 22 for rotation therewith.

Figure 4:
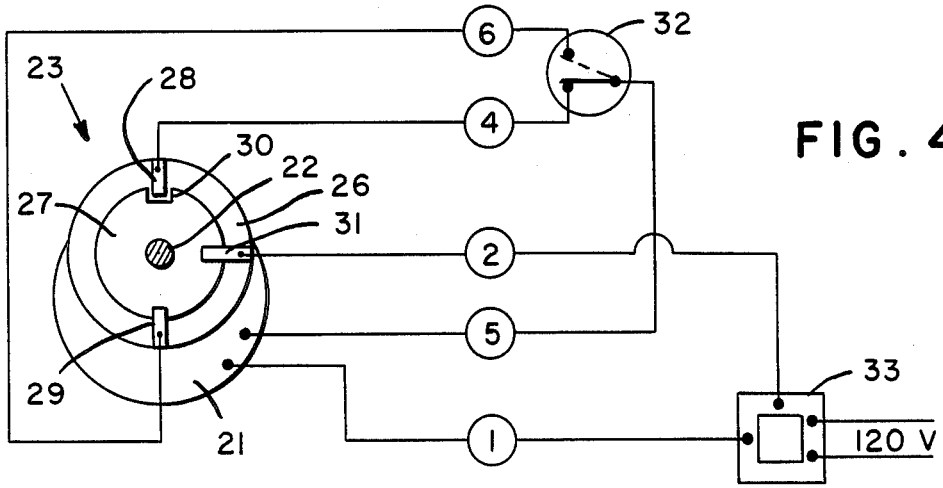
FIG. 4 is a sectional view taken along the line 4—4 of FIG. 1, showing the programmer for closed damper position.
Figure 5:
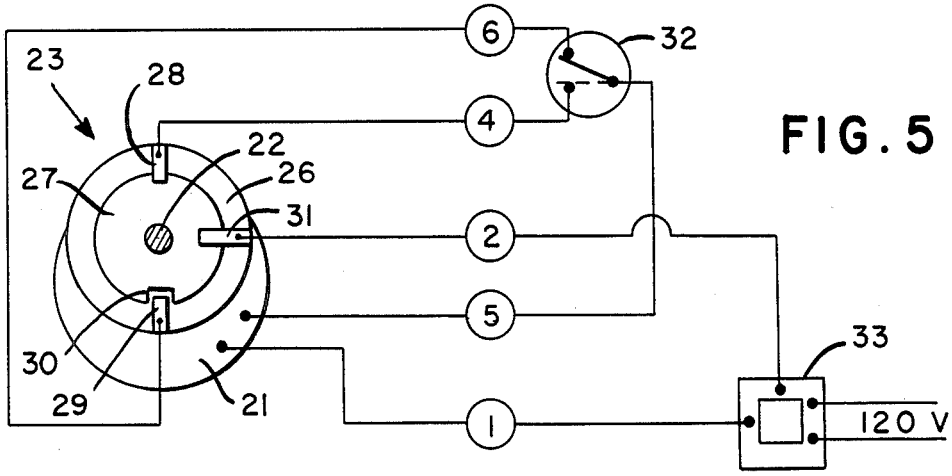
FIG. 5 is a view corresponding to that of FIG. 4 but illustrating the rotation programmer disc revolved 180° for open position of the damper.

As shown most clearly in FIGS. 4 and 5, the fixed contact plate 26 supports opposed contact fingers 28 and 29 which are adapted to make electrical contact with the conductive disc 27 until such contact is broken by the alignment of the circuit-breaking recess of slot 30 of the disc 27 with either of said contact fingers 28 or 29. The fixed contact plate 26 also supports a longer third contact finger 31 which extends over or under the conductive disc 27 a sufficient distance to maintain continuous electrical contact with disc 27 even in the area of the slot 30.

As shown by FIGS. 1, 4 and 5, the automatic damper means also comprises a sensitrol type of thermostat 32, a transformer 33 and a terminal board 34 through which the motor 21 and thermostat 32 are interconnected to each other and to the transformer 33, the latter being connected to a 120 volt AC power source. The leads from contacts 28, 29 and 31 of the fixed contact plate 26 are attached to points 4, 6 and 2, respectively, of the terminal board 34. The leads from the motor 21 are attached to points 1 and 5 of the board 34, the leads from the transformer 33 are attached to points 1 and 2 of the board 34, and the three leads from the thermostat 32 are attached to points 4, 5 and 6 of the terminal board 34.

Figure 2:
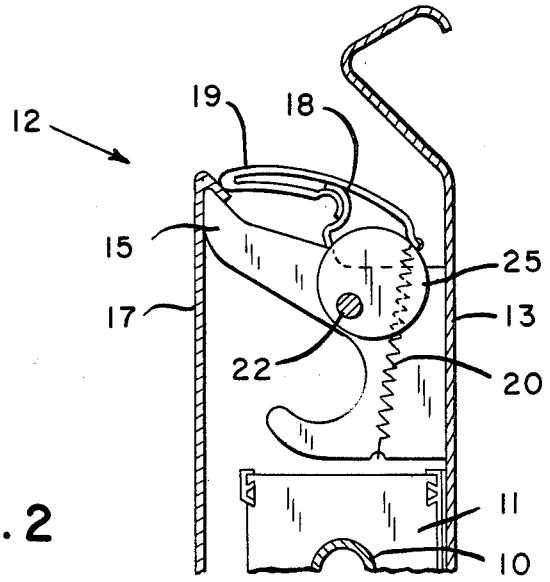
FIG. 2 is a sectional view taken along the line 2—2 of FIG. 1, showing the damper in closed position.

FIG. 4 illustrates the condition of the circuit for the closed position of the damper panel 19, as illustrated by FIGS. 1, 2, 6 and 7. In such condition, the thermostat 32 is satisfied, i.e., it senses that the temperature within the room or service area is equal to or greater than the desired temperature, which desired temperature is preset by a manual adjustment to a value of, for example, 65° F. Thus, the thermostat is not calling for more heat and the motor is not energized because the circuit between the motor 21 and the transformer 33, through point 4 of the terminal board 34 and contact finger 28 of the fixed contact plate 26 is broken due to the location of the slot 30 adjacent contact finger 28. Thus, the cam wheel 25 of FIG. 2 is held in the position shown, in which position it pushes upward against an inner edge of the damper panel 19 to extend the spring 20 and hold the damper panel 19 in closed position.

Even though the master or furnace thermostat, located in another room or central area of the living space, may be pre-set to maintain a higher temperature throughout the living space, such as 70° F., the presence of secondary or satellite damper-control thermostats 32 in certain of the rooms, such as unused bedrooms, basement areas, etc., enable the ambient temperature in such rooms or areas to be maintained lower than the maximum temperature permitted by the master thermostat by closing the damper panel 19 to block air circulation through the housings 12, thereby consrving heat by reducing heat-transfer from the overall system, returning hotter water to the furnace boiler and reducing the duration at which the furnace must be operated to maintain the necessary water temperature in the boiler.

Figure 3:
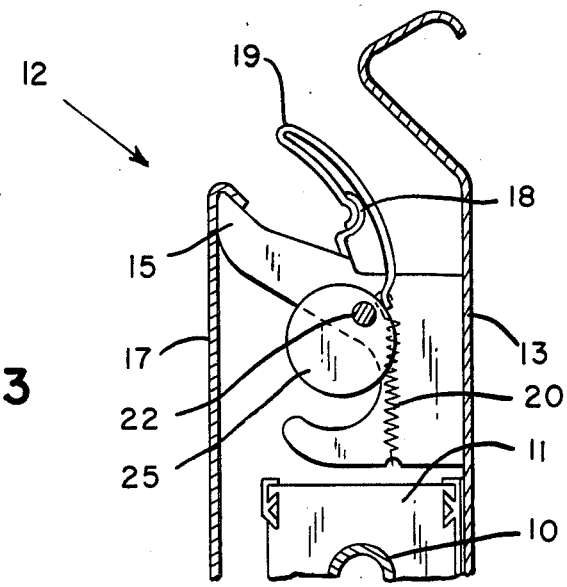
FIG. 3 is a view corresponding to that of FIG. 2 but illustrating the cam wheel revolved 180° and the damper in open position.
Figure 8:
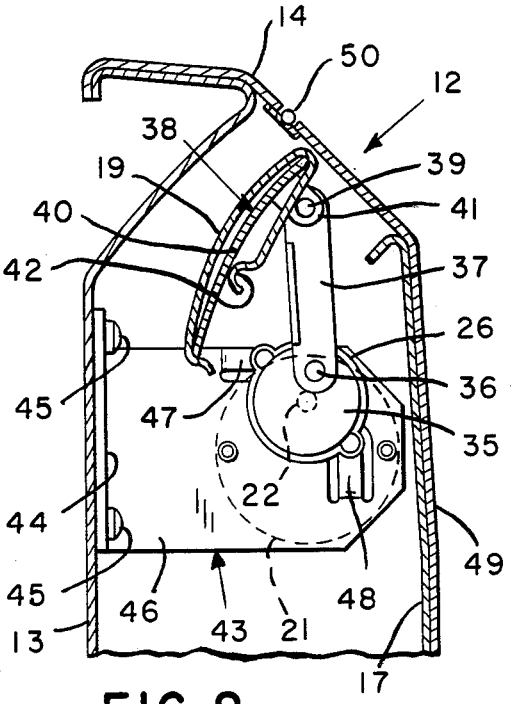

FIG. 5 illustrates the condition of the circuit for the open position of the damper panel 19, as illustrated by FIGS. 3 and 8. Thus, when the temperature in the room or space falls below the desired temperature, as pre-set on the damper-control thermostat 32, the thermostat lead to point 6 of the terminal board 34 is energized, as shown, to connect the motor 21 to the contact 29 of the fixed contact plate 26 and complete the circuit through the transformer 33. This energizes the motor 21 to cause shaft 22 and contact disc 27 to turn slowly until the slot 30 has been rotated 180° to a position adjacent contact 29, as shown by FIG. 5 thereby breaking the circuit and stopping the motor. Referring to FIG. 3, such rotation is imparted to the cam wheel 25 to move it to the position shown, during which movement the frictional contact between the periphery of the wheel 25 and the inside edge of the damper panel 19 is relaxed and broken, permitting the inside edge of the damper panel 19 to be pulled downward gradually by the spring 20 to cause the damper panel 19 to be pivoted to the open position shown by FIG. 3.

Such open position permits the free rise and escape of heated air from within the radiator housing 12 and maximum normal circulation of ambient air through the radiator housing. This permits the room or area to receive maximum warm air from the radiator until the ambient air temperature within the room or area rises to the temperature pre-set on the damper thermostat 32. At such time, the thermostat 32 is again activated to energize the lead to point 4 and contact finger 28, as shown by FIG. 4, to rotate the shaft 22 and cam wheel 25 one half rotation, i.e., 180°, to move the damper panel 19 to closed positon, shown by FIG. 2.

Figure 6:
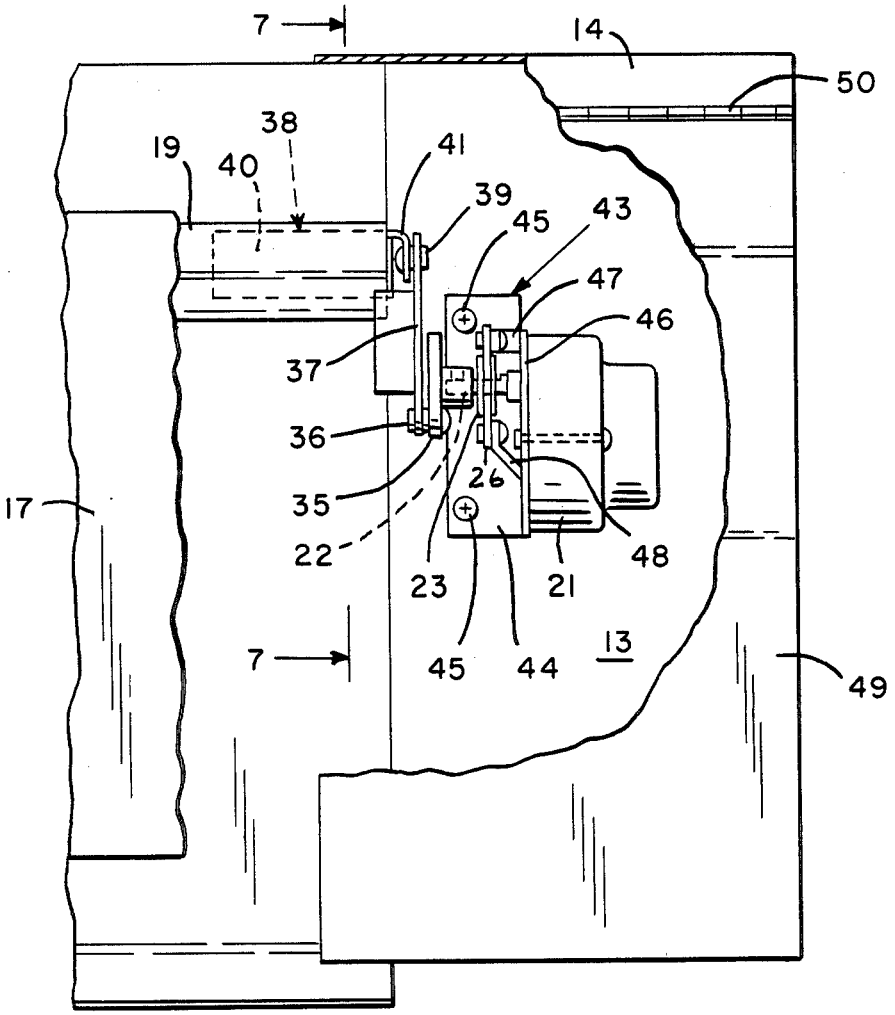
FIG. 6 is a front view of an hydronic baseboard radiator assembly according to a preferred embodiment of the present invention, portions thereof being broken away for purposes of illustration, and the wiring, terminal board, transformer and thermostat being omitted since such elements are previously shown by FIG. 1.
Figure 7:
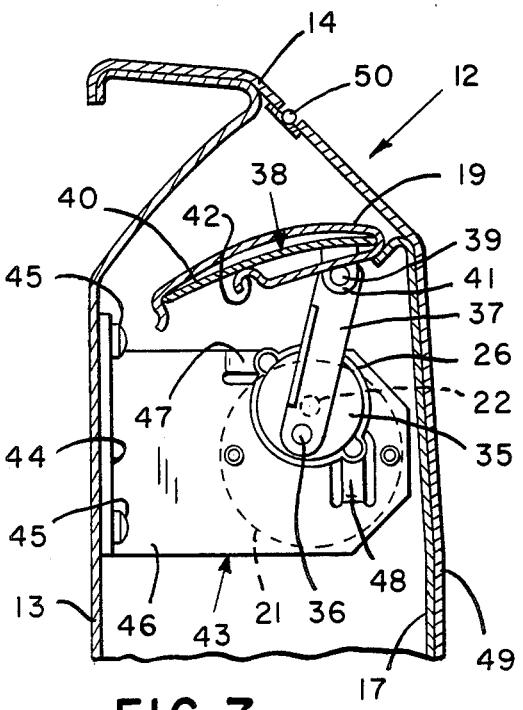
FIG. 7 is a sectional view taken along line 7—7 of FIG. 6, showing the damper in closed position, and FIG. 8 corresponds to FIG. 7 but illustrates the damper panel in open position.

The assembly of FIGS. 6 to 8 is a preferred embodiment of the present invention since the damper-actuator extension thereof is capable of being retrofitted to an existing hydronic radiator housing, such as disclosed in U.S. Pat. No. 3,386,501, without any modification of the damper panel. Such embodiment is also preferred because it provides a positive attachment between the damper panel and the damper-actuator extension to control movement of the damper panel to both open and closed positions, and obviates the need for springs or other biasing means on the damper panel.

Referring to FIGS. 6 to 8, the damper-actuating means thereof is identical to the damper actuating means illustrated by FIG. 1 except with respect to the damper-actuator extension and its attachment to the motor shaft. Therefore, indentical reference numbers are used in FIG. 1 and in FIGS. 6 to 8 to identify identical elements, and the rotation programmer 23 of FIGS. 6 to 8 is shown without the detail illustrated by FIG. 1.

Thus, in FIG. 6 the motor shaft 22 has fixed to the end thereof a wheel 35 having an off-set pin 36 which is rotatably engaged within a hole through one end of a drive link 37, the other end of the drive link 37 being rotatably attached to a damper adapter 38 by means of a pin 39. As shown by FIGS. 7 and 8, the point of pivotal attachment between the drive link 37 and the damper adaptor 8 is at a front position, spaced from the center of the damper panel 19 where the damper panel is supported for pivotal movement over the hinge tabs 18 of the support arms 15 of the radiator housing, as illustrated by the embodiment of FIGS. 2 and 3.

The damper adaptor 38 comprises a slightly curved extension plate 40 having a downwardly extending tab 41 having a hole through which the pin 39 of the drive link 37 extends. The extension plate 40 is inserted into the end of the damper panel 19 and is frictionally engaged therewithin and secured by its confinement between the undersurface of the top of the damper panel and the upper surface of the hinge tab-engagement extension 42. Such insertion and confinement is possible without any modification of the damper panel, which enables the present damper-actuating means to be retrofitted to existing radiator housings.

The damper actuating means of the embodiment of FIGS. 6 to 8 is exactly the same as discussed hereinbefore in connection with the embodiment of FIGS. 1 to 3, the rotation programmer 23 and its operation being as illustrated in FIGS. 4 and 5 and as discussed in connection with the embodiment of FIGS. 1 to 3. Thus, FIGS. 6 and 7 illustrate the position of the motor drive wheel 35, drive link 37 and damper panel 19 when the thermostat is satisfied, i.e., not calling for more heat in the room or area in which the system is located. In such position the rotation programmer 23 is stopped in the condition illustrated by FIG. 4 and the damper panel is closed.

When the thermostat setting is raised or when the temperature within the room or area drops below the temperature setting on the thermostat, the motor 21 is energized through the rotation programmer 23 in the same manner as discussed hereinbefore in connection with the embodiment of FIGS. 1 to 3. This causes motor shaft 22 and the attached drive wheel 35 to rotate 180° until the programmer 23 moves to the condition illustrated by FIG. 5 to deactivate the motor. Rotation of the shaft 22 and wheel 35 causes the pin 36 of the wheel 35 to be moved from the lower position shown in FIG. 7 to the higher position shown in FIG. 8 and to push upwardly on the drive link 37 during such movement. The drive link 37 also pushed upwardly agianst the damper actuator 38 to cause the damper panel 19 to be pivoted by frictional engagement between the radiator hinge tabs 18 (shown in FIGS. 2 and 3) and the mating extension 42 of the damper panel. In such condition the damper panel 19 is in open position to permit the free circulation of air through the radiator housing to increase the amount of heat circulated into the room or area being heated.

As is clear from FIGS. 6 to 8, the damper panel 19 is positively attached to the drive wheel 35, through the drive link 37, so that rotation of the drive wheel 35 and its eccentrically-attached pin 36 pushes the damper panel into open position and pulls the damper panel into closed position without the need for springs or biasing means.

FIGS. 6 to 8 also illustrate the means for attachment of the motor 21 to the rear panel 13 of the radiator housing 12. Such means comprises a support bracket 43 having a base 44 which is affixed to the rear panel 13 by means of screws 45, and having an extension plate 46 which is attached to the motor 21. The plate 46 also includes tabs 47 and 48 which are bent out from the plate 46 to provide attachment points for the fixed contact plate 26 of the rotation programmer 23, spaced from the plane of the extension plate 46. Plate 46 also has an opening to permit free extension of the motor shaft 22 therethrough.

Preferably, the end panel 14 of the present radiator housings includes an access door 49 which is attached by means of a horizontal hinge 50, so that the present damper-actuating assemblies can be attached, adjusted, repaired or replaced conveniently, as shown by FIGS. 6 to 8.

It will be clear to those skilled in the art, in the light of the present disclosure, that a variety of different means may be used to cause the mechanical movement of the damper panel 19 between open and closed positions in response to an electrical signal, and that the damper panel may be located at the bottom of the radiator housing to block the entry of cool air into the housing rather than the escape of heated air from the top of the housing. In either event air circulation through the housing is impeded. It should also be understood that the present invention applies to radiator housings regardless of the nature of the heat-transfer element. The most common systems are hydronic systems in which the heat-transfer element circulates hot water, but other systems which circulate steam, hot oil or other fluids may also be used within the novel radiator housing assemblies of the present invention.

Variations and modifications of the present invention will be apparent to those skilled in the art within the scope of the present claims.

We claim:

1. Radiator housing assembly having an automatic damper control, comprising a housing adapted to substantially enclose a heat-transfer element the temperature of which is controlled by a master thermostat, said housing having front and rear substantially vertical panels adapted to contain said heat-transfer element therebetween, a damper panel, and hinge means attached to said housing and supporting said damper panel for movement in one direction to a closed position in which it extends between said front and rear panels to block the circulation of ambient air between said panels and past said heat-transfer element and in the opposite direction to an open position in which it permits the free circulation of ambient air between said front and rear panels and past said heat transfer element, electrical damper-positioning means spaced from said hinge means and comprising a motor having a shaft which is adapted to rotate at slow speed, said shaft supporting an eccentric drive element which is connected with said damper panel so that the rotation of said shaft causes the movement of said eccentric drive element and connected damper panel to move said damper panel on said hinge means between the open and closed positions, and ambient temperature-sensing electrical remote control means connected to said motor to actuate said motor, rotate said shaft and move said eccentric drive element and connected damper panel to closed position when the temperature of the ambient air reaches a predetermined maximum level, and to actuate said motor, rotate said shaft and move said eccentric drive element and connected damper panel to open position when the temperature of the ambient air reaches a predetermined minimum level.

2. Radiator housing assembly according to claim 1 in which said housing is a baseboard radiator and said front and rear panels are elongated, side panels extending between said front and rear panels, to form side walls, at least one said damper panel, said damper panel being elongated and at least one said electrical damper-positioning means connected to said control means.

3. Radiator housing assembly according to claim 1 in which said damper panel is normally biased for movement into one position and said damper-positioning means is adapted to move said damper panel into said other position against the force of the bias.

4. Radiator housing assembly according to claim 3 which comprises a spring means between said damper panel and said housing for biasing said damper panel towards open position.

5. Radiator housing assembly according to claim 1 in which said eccentric drive element is adapted to frictionally engage said damper panel whereby rotation of said shaft causes movement of said eccentric drive element and movement of said damper panel between open and closed positions.

6. Radiator housing assembly according to claim 1 in which said eccentric drive element comprises a drive wheel attached to said shaft for rotation therewith and a drive link one end of which is rotatably attached to said drive wheel at a position spaced from the center of rotation thereof, the other end of said drive link being attached to said damper panel, to provide a positive attachment between said panel and said shaft.

7. Radiator housing assembly according to claim 6 which further comprises a damper panel attachment which is frictionally engaged by said damper panel and which is rotatably attached to the other end of the drive link.

8. Radiator housing assembly according to claim 5 in which said damper panel is biased for normal movement into one of said positions, and said shaft being adapted to rotate said cam element against said damper panel to move said damper panel between open and closed positions.

9. Radiator housing assembly according to claim 1 in which said motor comprises means for controlling the extent of rotation of said shaft and for de-actuating said motor when said shaft has rotated to said extent.

10. Radiator housing assembly according to claim 9 in which one full revolution of said shaft is adapted to cause movement of said damper panel from one position to the other position and back to said one position, and said means for controlling the extent of rotation of said shaft is adapted to deactuate said motor after each one-half revolution of said shaft.

11. Radiator housing assembly according to claim 1 in which said remote control means comprises a secondary thermostat which is located in closer proximity to said damper-positioning means than is said master thermostat which controls the temperature of said heat-transfer element, said secondary thermostat being adjustable to a lower temperature than said master thermostat whereby it does not cause actuation of said damper-positioning means to open said damper panel until the temperature in said proximity falls below said lower temperature.

12. A radiator housing assembly according to claim 1 wherein said electrical damper-positioning means and said electrical remote control means are part of an electrical circuit including an electrical power source and a programming switch control means.

* * * * *